US006722468B2

(12) United States Patent
Albano

(10) Patent No.: US 6,722,468 B2
(45) Date of Patent: Apr. 20, 2004

(54) SUSPENDED SCAFFOLDING SYSTEM

(76) Inventor: James R. Albano, 975 Linda Vista Dr., San Marcos, CA (US) 92069

( * ) Notice: Subject to any disclaimer, the term of this patent is extended or adjusted under 35 U.S.C. 154(b) by 0 days.

(21) Appl. No.: 10/066,313

(22) Filed: Feb. 1, 2002

(65) Prior Publication Data

US 2003/0146049 A1 Aug. 7, 2003

(51) Int. Cl.[7] ..... E04G 3/00; E04G 3/10
(52) U.S. Cl. ..... 182/82; 182/150
(58) Field of Search ..... 182/82, 150, 45, 182/113, 112; 248/214, 235, 250

(56) References Cited

U.S. PATENT DOCUMENTS 4,276,957 A 7/1981 Kilgore
4,909,350 A 3/1990 Jacobs
5,535,974 A 7/1996 Savitski
5,829,549 A * 11/1998 Flynn ..... 182/82
5,878,835 A 3/1999 Gall
6,039,150 A * 3/2000 Palmer ..... 182/113

* cited by examiner

*Primary Examiner*—Hugh B. Thompson, II
(74) *Attorney, Agent, or Firm*—Luce, Forward, Hamilton & Scripps

(57) ABSTRACT

A suspended scaffolding system and method of use employs a plurality of scaffolding brackets that are hung from the framework of a building under construction to support a plurality of scaffolding planks to form a walkway therebetween. The scaffolding brackets include an anchor assembly, which is specially designed to wrap around the building's framework such that construction workers can complete their work without removing the brackets.

25 Claims, 2 Drawing Sheets

SUSPENDED SCAFFOLDING SYSTEM

FIELD OF THE INVENTION

The present invention is directed to scaffolding systems, and more particularly to a suspended scaffolding system that is securely attached to a building under construction.

BACKGROUND OF THE INVENTION

During construction of a building, workers frequently assemble scaffolding to allow an elevated platform from which to work on higher portions of the building. Conventional scaffolding systems consist of a number of sections that are based on the ground and stacked to build up to a desired height. However, these systems suffer from a number of disadvantages. For example, typical scaffolding systems are difficult to assemble and transport because they are heavy and cumbersome. In light of these disadvantages, suspended or portable scaffolding systems have been developed.

Suspended scaffolding systems are usually attached directly to the building under construction and, therefore, do not require leveling according to ground conditions. In addition, suspended scaffolding systems are lighter and much easier to assemble and transport than conventional scaffolding systems. However, these suspended systems suffer from a number of disadvantages as well. For example, some suspended scaffolding systems require expensive anchor assemblies to be installed on the building structure. Other suspended scaffolding systems utilize support brackets that block access to portions of the building's infrastructure such that the job cannot be completed until the scaffolding system is disassembled.

Therefore, there exists a need for a suspended scaffolding system that requires minimal assembly time and does not interfere with completion of construction of the building.

To the extent that specific publications are discussed above, these discussions should not be taken as an admission that the discussed publications (e.g., patents) are prior art for patent law purposes. For example, some or all of the discussed publications may not be sufficiently early in time and/or sufficiently enabling so as to amount to prior art for patent law purposes.

SUMMARY OF THE INVENTION

At least some embodiments of the present invention may exhibit one or more of the following objects, advantages and benefits:

One aspect of the present invention involves a suspended scaffolding bracket for a building under construction, comprising a vertical support, a horizontal support and an anchor assembly structured to fit about a crossbeam of the building such that construction work adjacent the crossbeam can be completed without removing the scaffolding bracket.

Another aspect of the present invention involves a suspended scaffolding bracket for a building under construction, comprising a vertical support, a horizontal support and an anchor assembly; wherein the anchor assembly includes a vertical plate and a horizontal plate structured to fit across only a portion of the top surface of the crossbeam.

A further aspect of the present invention involves a suspended scaffolding bracket for a building under construction, comprising a vertical support, a horizontal support, and a brace member for receiving a cross-support, wherein the cross-support is structured to span at least three studs of the building under construction.

Another aspect of the present invention involves a suspended scaffolding bracket for a building under construction, comprising a vertical support, a horizontal support and an anchor assembly structured to fit about a crossbeam of the building, wherein the anchor assembly includes a vertical plate and a horizontal plate dimensioned to extend across only a portion of a top surface of the crossbeam in a direction from the inside surface of the crossbeam toward an outside surface of the crossbeam, whereby a leading edge of the top surface of the crossbeam is unobstructed and a freeze block can be installed in contact with the leading edge without removing the bracket.

Yet another aspect of the present invention involves a suspended scaffolding system for a building under construction, comprising a plurality of scaffolding brackets, each bracket comprising a vertical support, a horizontal support, and an anchor assembly structured to fit about a crossbeam of the building such that construction work adjacent the crossbeam can be completed without removing the scaffolding bracket; and a plurality of scaffolding planks spanning the plurality of scaffolding brackets to form a walkway.

An additional aspect of the present invention involves a suspended scaffolding system for a building under construction, comprising a plurality of scaffolding brackets, each bracket comprising a vertical support, a horizontal support, and an anchor assembly; and a plurality of scaffolding planks spanning the plurality of scaffolding brackets to form a walkway, wherein each horizontal plate is structured fit across only a portion of the top surface of a crossbeam.

A further aspect of the present invention involves a method of installing a suspended scaffolding system around a building under construction, including the steps of: providing a plurality of scaffolding brackets, each scaffolding bracket including a horizontal support, a vertical support, and an anchor assembly structured to fit about a crossbeam of the building under construction; and maneuvering each scaffolding bracket such that each anchor assembly is positioned across upper and inner surfaces of a crossbeam of the building under construction, wherein each anchor assembly includes a horizontal plate structured to fit across only a portion of the upper surface of the crossbeam.

DETAILED DESCRIPTION OF THE PREFERRED EMBODIMENTS

The present invention discloses a suspended scaffolding system, which employs a plurality of scaffolding brackets that are hung from the framework of a building under construction. These scaffolding brackets are specially designed to wrap around the building's framework such that construction workers can complete their work without removing the brackets. Like conventional scaffolding brackets, the brackets of the present invention are used to support a plurality of scaffolding planks to form a walkway therebetween.

Figure 1:
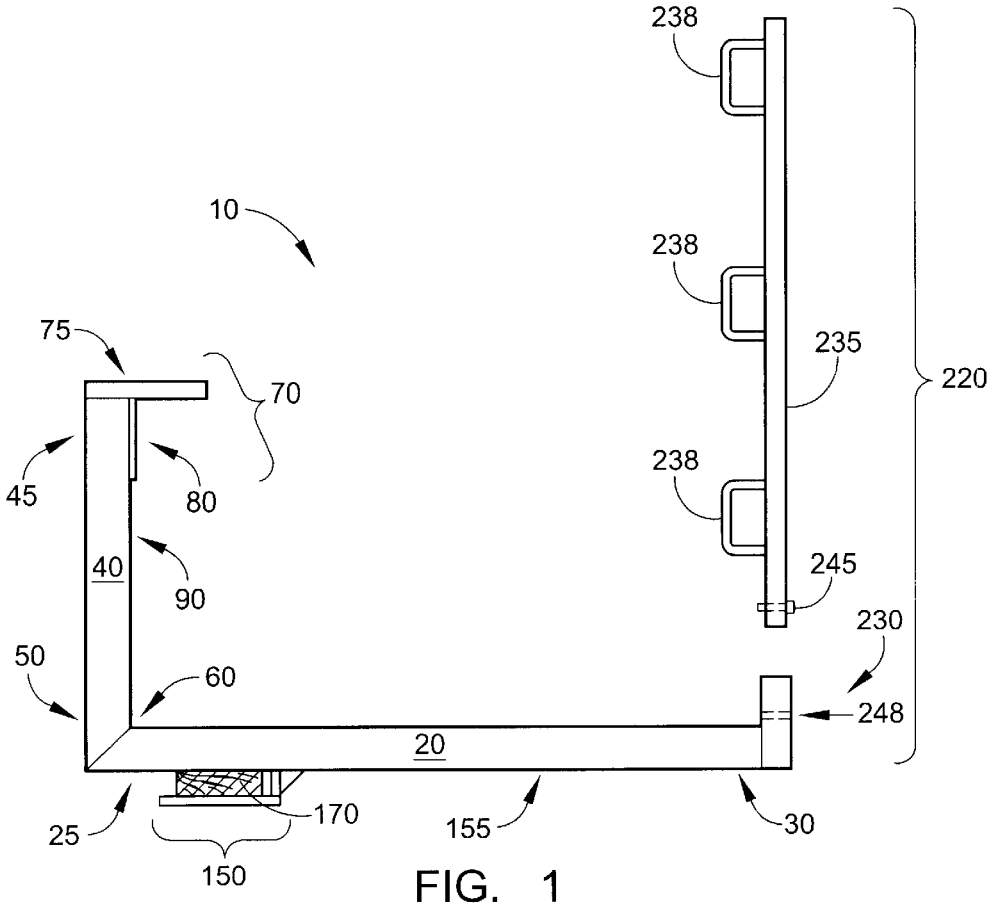
FIG. 1 is a side view of an exemplary embodiment of a suspended scaffolding bracket for use in a suspended scaffolding system for a building under construction according to the present invention.

FIG. 1 depicts an exemplary embodiment of a suspended scaffolding bracket 10 for use in a suspended scaffolding system for a building 15 under construction. As best seen in FIG. 1, the scaffolding bracket 10 includes a horizontal support 20 having a first end 25 and a second end 30, and a vertical support 40 having a top end 45 and a bottom end 50. The supports 20,40 preferably consist of square steel tubing connected at elbow joint 60 by welding or by fasteners such as bolts or rivets. As one of ordinary skill in the art can appreciate, the tubing may be another shape such as circular and the material may be an alternative to steel such as aluminum without departing from the scope of the invention.

Figure 2:
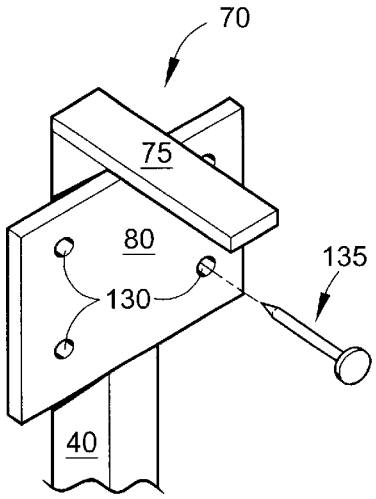
FIG. 2 is a perspective view of an exemplary embodiment of an anchor assembly for a suspended scaffolding bracket according to the present invention.

As best seen in FIG. 2, the vertical support 40 further includes an anchor assembly 70 integral with top end 45. The anchor assembly 70 includes a horizontal plate 75, which extends inwardly from the top end 45 of the vertical support 40 in a horizontal direction, and a vertical plate 80, which extends downwardly from the horizontal plate 75 plate along an inside surface 90 of vertical support 40. With further reference to FIG. 1, the two plates 75,80 form an inverted L-shape on the inside surface 90 of the top end 45 of vertical support 40. The plates 75,80 are preferably made of a strong durable material such as steel or aluminum.

Figure 3:
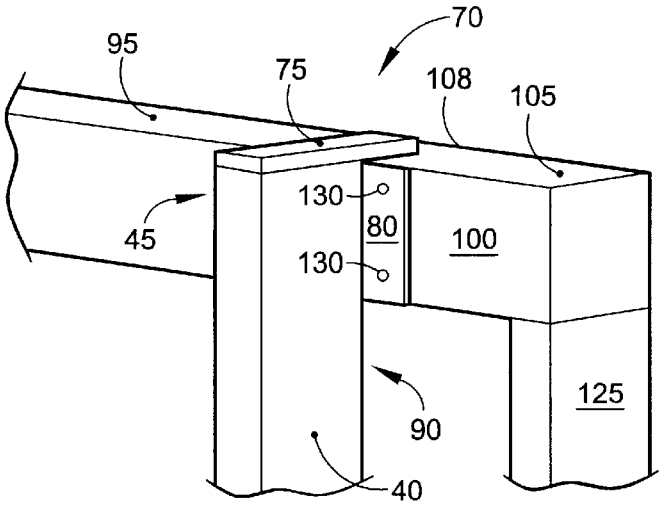
FIG. 3 is a perspective view of the anchor assembly of FIG. 2 attached to a crossbeam of a building under construction according to the present invention.
Figure 6:
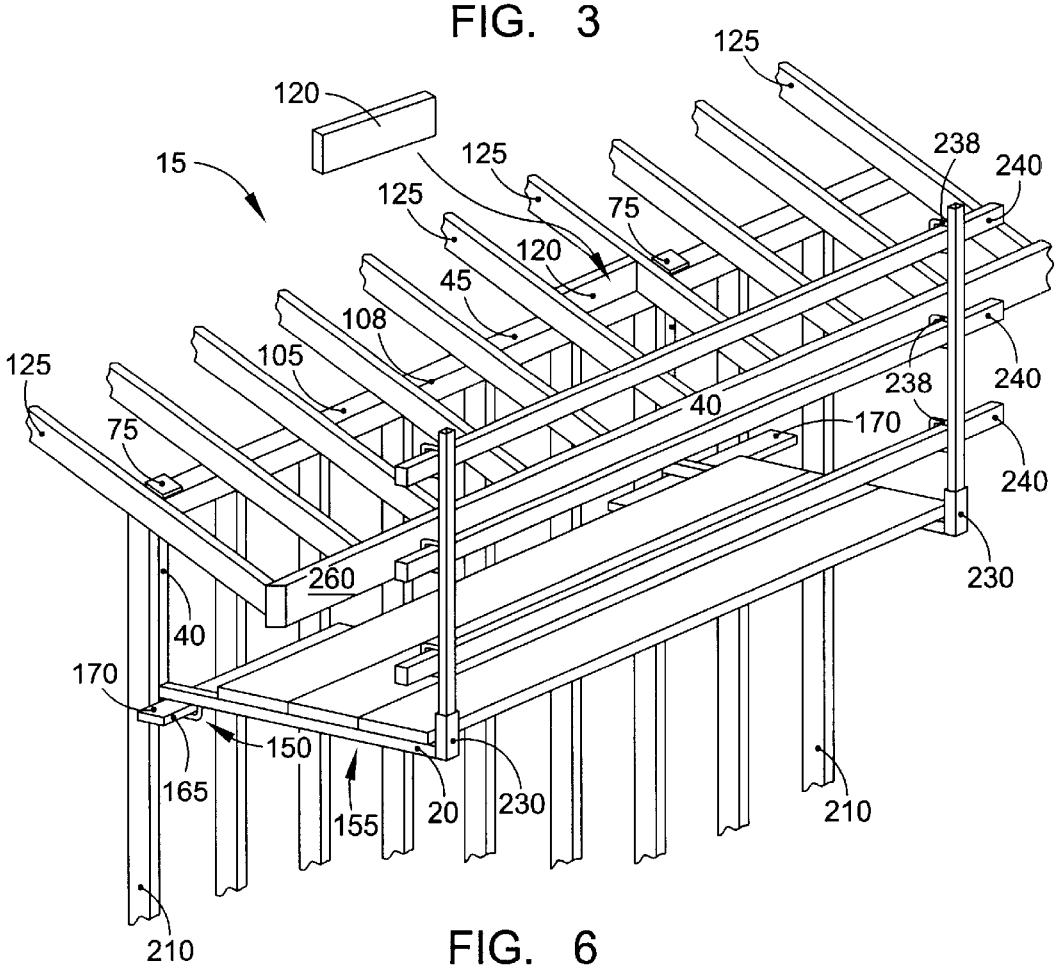
FIG. 6 is a perspective view of an exemplary embodiment of an assembled suspended scaffolding system for a building under construction according to the present invention.

As seen in FIGS. 3 and 6, the anchor assembly 70 is structured to be wrapped underneath and atop a crossbeam 95, which may be a solid beam or a pair of stacked 2×4s. During use of the scaffolding system, the anchor assembly 70 is positioned so that the vertical plate 80 is in contact with an inside surface 100 of the crossbeam 95 and the horizontal plate 75 is in contact with a portion of the top surface 105 of crossbeam 95. Importantly, a leading edge 108 of the top surface 105 of crossbeam 95 is unobstructed by the scaffolding bracket 10 and, therefore, remains accessible so that certain jobs can be completed without removing the bracket 10. For example, as best seen in FIG. 6, freeze blocks 120 are typically installed in contact with the leading edge 108 of the crossbeam 95 in between roofing rafters 125. Since anchor assembly 70 wraps around the crossbeam 95 and permits access to the leading edge 108, installation of the freeze blocks 120 may be conveniently accomplished without removing the brackets 10.

As best seen in FIG. 2, the vertical plate 80 of the anchor assembly 70 includes a plurality of apertures 130 structured to receive fasteners 135 such as nails, bolts, rivets or screws, for further securing the anchor assembly 70 to a crossbeam 95 after the initial fitting. The primary function of fasteners 135 is to prevent the brackets 10 from shifting after installation.

Figure 4:
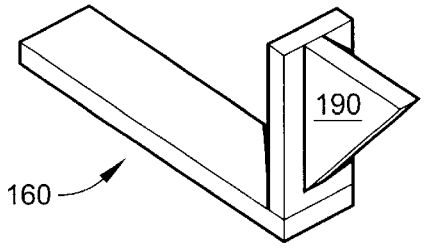
FIG. 4 is a perspective view of a first exemplary embodiment of a brace for a suspended scaffolding bracket according to the present invention.
Figure 5:
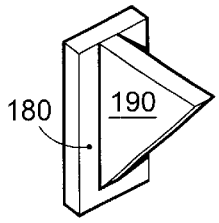
FIG. 5 is a perspective view of a second exemplary embodiment of a brace for a suspended scaffolding bracket according to the present invention.

As seen in FIGS. 1, 4 and 5, the suspended scaffolding bracket 10 also includes a brace 150 attached to a lower side 155 of the horizontal support 20. With reference to FIG. 4, in a first exemplary embodiment, the brace 150 is an L-shaped brace 160, whereby the L-shaped brace 160 and the lower side 155 of the horizontal support 20 form a U-shaped opening for receiving a side edge 165 of a cross-support 170 such as a 2×4. With reference to FIG. 5, in a second exemplary embodiment, the brace 150 is a horizontal plate 180, which forms an abutment for a flat side 185 of cross-support 170. In either exemplary embodiment, the brace 150 may further include an angled support 190 for added stability and a mounting plate (not shown) for attachment to the horizontal support 20. Preferably, the brace 150 is made of a strong durable material such as steel or aluminum and may be affixed to the horizontal support 20 by welding or using fasteners (not shown) such as bolts, rivets or screws.

As weight is applied to the horizontal support 20 of the scaffolding bracket 10 in the form of workers and equipment, the resulting stresses are offset by the cross-support 170, which distributes the stresses across a plurality of studs 210. To achieve proper stress distribution, the cross-support 170 is dimensioned to span at least three studs 210 of the building 15. Conveniently, the vertical support 40 is positioned inside of and approximately parallel to a stud 210 so as to not impede on the workspace of the construction workers.

As seen in FIGS. 1 and 6, a railing system 220 is mounted near the second end 30 of horizontal support 20. The railing system 220 includes a safety post receiver 230, which is a hollow tube structured to releasably receive a safety post 235. The safety post 235 includes a plurality of vertically spaced channels 238 designed to receive horizontal safety rails 240. As best seen in FIG. 1, a quick release pin 245 is provided on the safety post and a corresponding opening 248 is provided on the safety post receiver 230 to facilitate assembly and disassembly of the railing system 220.

An exemplary embodiment of a suspended scaffolding system using a plurality of scaffolding brackets 10 according to the present invention will now be described. As seen in FIGS. 1 and 6, the scaffolding system includes a pair of scaffolding brackets 10, each including a horizontal support 20, a vertical support 40, an anchor assembly 70 for attachment to a crossbeam 95, a brace 150 for receiving a cross-support 170, and a railing assembly 220. The scaffolding system further includes a plurality of scaffolding planks 250 spanning the pair of scaffolding brackets 10 to form a walkway for the workers.

With further reference to FIG. 6, the scaffolding system is particularly useful in connection with roofing jobs. The square tubing of the scaffolding brackets 10 is strong enough to safely design a horizontal support 20 that is approximately 4 feet in length. A horizontal support 20 of this length provides ample working room between the fascia board 260 and the railing assembly 220. An additional advantage of the scaffolding brackets 10 is that each anchor assembly 70 is dimensioned to be fitted underneath and atop crossbeam 95 so that the leading edge 108 of the top surface 105 of crossbeam 95 is not blocked by the horizontal plate 75. This is an important feature since most roofing projects cannot be completed if the leading edge 108 is blocked. For example, typical roofing projects require freeze blocks 120 to be installed in contact with the leading edge 108 of the crossbeam 95 in between roofing rafters 125. Since the anchor assembly 70 wraps around the crossbeam 95 and permits access to the leading edge, installation of the freeze blocks 120 may be conveniently accomplished without removing the brackets 10.

A method of installing a suspended scaffolding system around a building under construction according to an exemplary embodiment of the present invention will now be described. With further reference to FIGS. 1 and 6. The method begins with the step of providing a plurality of scaffolding brackets 10 according to one of the previously described embodiments. Next, each of the scaffolding brackets 10 is maneuvered so that the anchor assembly 70 is positioned across the inside 100 and top surfaces 105 of a crossbeam 95 of the building 15 under construction. The maneuvering step is accomplished by lifting each scaffolding bracket 10 and positioning the anchor assembly 70 around the inside surface 100 of the crossbeam 95. Maneuvering each bracket in this manner achieves the goal of positioning each scaffolding bracket 10 such that construction work along the leading edge 120 of the crossbeam 95 can be completed without removing the scaffolding bracket 10.

After maneuvering the anchor assembly 70 into position about the crossbeam 95, the next step consists of lifting the second end 30 of horizontal support 20 up just a few inches and positioning a side edge 165 of the cross-support 170 into the U-shaped opening formed by the L-shaped brace 160 and the bottom surface 155 of the horizontal support 20. However, if the brace 150 is a horizontal plate 180, the step consists of lifting the second end 30 of horizontal support 20 and positioning a flat side 185 of the cross-support 170 against the horizontal plate 180. In either case, the cross-support 170 should be positioned between the brace 150 and the studs 210 of the building 15 such that the cross-support 170 spans at least three studs 210. The final step consists of laying scaffolding planks 250 across the horizontal supports 20 of the scaffolding brackets 10 to form a walkway.

An additional step may include securing each scaffolding bracket 10 to the crossbeam 95 with fasteners 135 extending through the plurality of apertures 130 in vertical plate 80. A further step may include assembling the railing system 220 by slipping the safety post 235 into the safety post receiver 230 and slipping horizontal safety rails 240 through the vertically spaced channels 238.

The description and examples set forth in this specification and associated drawings set forth preferred embodiment (s) and some of the possible variations of the present invention. The specification and drawings are not intended to limit the exclusionary scope of this patent document. Many designs other than the above-described embodiments will fall within the literal and/or legal scope of the following claims. Because it is generally impossible for a patent to describe in its specification every conceivable and possible future embodiment of the invention, the exclusionary scope of this patent document should not be limited by features: (1) reflected in the specification and drawings, but (2) not explicated or reasonably implicated by the language of the following claims.

What is claimed is:

1. A suspended scaffolding bracket for a building under construction having one or more studs and crossbeams, the scaffolding bracket comprising:

horizontal support having a first end and a second end a vertical support having a top end and a bottom end, wherein the bottom end is attached to the first end of the horizontal support; and an anchor assembly comprising:

a first plate that extends inwardly along a substantially horizontal plane across the top end of the vertical support toward the second end of the horizontal support;

a second plate disposed on an inside surface of the vertical support that extends along a substantially vertical plane from the first plate toward the horizontal support; and a brace coupled to the bottom end of the vertical support for receiving a cross-support;

wherein the second plate includes one or more apertures adapted to receive fasteners for releasably securing the anchor assembly to a crossbeam;

wherein the first and second plates are adapted to make contact with top and inside surfaces, respectively, of a crossbeam of the building such that construction work adjacent the crossbeam can be completed without removing the scaffolding bracket.

2. The suspended scaffolding bracket of claim 1, wherein the first plate is adapted to make contact with only a portion of the top surface of the crossbeam.

3. The suspended scaffolding bracket of claim 1, wherein the brace is L-shaped.

4. The suspended scaffolding bracket of claim 3, wherein the cross-support is adapted to span at least three studs of the building tinder construction.

5. The suspended scaffolding bracket of claim 1, wherein the brace includes a vertical plate forming an abutment for the cross-support.

6. The suspended scaffolding bracket of claim 5, wherein the cross-support is adapted to span at least three studs of the building under construction.

7. The suspended scaffolding bracket of claim 1, further including a safety post receiver attached to an upper side of the second end of the horizontal support.

8. The suspended scaffolding bracket of claim 7, wherein the safety post receiver is a hollow tube adapted to releasably receive a safety post.

9. The suspended scaffolding bracket of claim 8, wherein the safety post includes a plurality of vertically spaced channels adapted to receive horizontal safety rails.

10. The suspended scaffolding bracket of claim 1, wherein the vertical support is adapted to be positioned inside of and approximately parallel to a stud of the building under construction.

11. The suspended scaffolding bracket of claim 1, wherein the first plate is adapted to extend across the top surface of the crossbeam in a direction from the inside surface of the crossbeam toward an outside surface of the crossbeam.

12. The suspended scaffolding bracket of claim 11, wherein the first plate is adapted to extend across only a portion of the top surface of the crossbeam so that a leading edge of the top surface of the crossbeam is unobstructed and work adjacent to the leading edge can be completed without removing the bracket.

13. The suspended scaffolding bracket of claim 11, wherein the first plate is adapted to extend across only a portion of the top surface of the crossbeam so that a leading edge of the top surface of the crossbeam is unobstructed and a freeze block can be installed in contact with the leading edge without removing the bracket.

14. A suspended scaffolding system for a building under construction having one or more studs and crossbeams, the system comprising:

a plurality of scaffolding brackets, each bracket comprising:

a horizontal support having a first end and a second end;

a vertical support having a top end and a bottom end, wherein the bottom end is attached to the first end of the horizontal support; and an anchor assembly comprising:

a first plate that extends inwardly in a substantially horizontal plane across the top end of the vertical support toward the second end of the horizontal support, wherein the first plate is in contact with a top sun ace of a crossbeam; and a second plate disposed on a surface of the vertical support, the second plate extending in a substantially vertical plane from the top plate toward the horizontal support, wherein the second plate is in contact with an inside surface of the crossbeam;

coupled to the bottom end of the vertical support for receiving a cross-support; and a plurality of scaffolding planks spanning the plurality of scaffolding brackets and forming a walkway;

wherein the second plate includes one or more apertures adapted to receive fasteners for releasably securing the anchor assembly to a crossbeam.

15. The suspended scaffolding system of claim 14, wherein the first plate is in contact with only a portion of the top surface of the crossbeam.

16. The suspended scaffolding system of claim 14, wherein the brace is L-shaped.

17. The suspended scaffolding system of claim 14, wherein the cross-support spans at least three studs of the building under construction.

18. The suspended scaffolding system of claim 14, wherein the cross-support spans at least three studs of the building under construct on.

19. The suspended scaffolding system of claim 14, wherein each scaffolding bracket further includes a safety post receiver attached to an upper side of the second end of a horizontal support.

20. The suspended scaffolding system of claim 19, wherein the safety post receiver is a hollow tube adapted to releasably receive a safety post.

21. The suspended scaffolding system of claim 20, wherein the safety post includes a plurality of vertically spaced channels adapted to receive horizontal safety rails.

22. The suspended scaffolding system of claim 14, wherein the vertical support is disposed inside of and approximately parallel to a stud of the building.

23. The suspended scaffolding system of claim 14, wherein the first plate extends along the top surface of the crossbeam in a direction from the inside surface of the crossbeam toward an outside surface of the crossbeam.

24. The suspended scaffolding system of claim 23, wherein each the first plate extends across only a portion of the top surface of the crossbeam so that a leading edge of the top surface of the crossbeam is unobstructed and work adjacent to the leading edge can be completed without removing the brackets.

25. The suspended scaffolding system of claim 23, wherein each the first plate extends across only a portion of the top surface of the crossbeam so that a leading edge of the top surface of the crossbeam is unobstructed and a freeze block can be installed in contact with the leading edge without removing the brackets.

* * * * *

UNITED STATES PATENT AND TRADEMARK OFFICE

CERTIFICATE OF CORRECTION

PATENT NO. : 6,722,468 B2
DATED : April 20, 2004
INVENTOR(S) : James R. Albano

It is certified that error appears in the above-identified patent and that said Letters Patent is hereby corrected as shown below:

Column 6,
Line 17, please delete “vertical” and replace with -- horizontal --; and
Line 22, please delete “vertical” and replace with -- horizontal --.

Signed and Sealed this

Third Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,722,468 B2
DATED : April 20, 2004
INVENTOR(S) : James R. Albano

It is certified that error appears in the above-identified patent and that said Letters Patent is hereby corrected as shown below:

Column 6,
Line 3, please delete "vertical" and replace with -- horizontal --; and Column 7,
Line 9, please delete "vertical" and replace with -- horizontal --.

This certificate supercedes Certificate of Correction issued May 3, 2005.

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,722,468 B2
DATED : April 20, 2004
INVENTOR(S) : James R. Albano

It is certified that error appears in the above-identified patent and that said Letters Patent is hereby corrected as shown below:

Column 5,
Line 57, please insert -- a -- before “horizontal”;

Column 6,
Line 19, please delete “tinder” and replace with -- under --;

Column 7,
Line 3, please delete “sun ace” and replace with -- surface --;
Line 9, please insert -- a brace -- before “coupled”; and
Line 26, please delete “construct on” and replace with -- construction --.

Signed and Sealed this

Fifteenth Day of November, 2005

JON W. DUDAS
*Director of the United States Patent and Trademark Office*